US005595039A

United States Patent [19]

Lowery

[11] Patent Number: 5,595,039

[45] Date of Patent: Jan. 21, 1997

[54] CHAIRS OF ADJUSTABLE HEIGHT FOR USE IN CONCRETE CONSTRUCTIONS

[76] Inventor: John L. Lowery, 7940 Jefferson Hwy., Apt. 107, Baton Rouge, La. 70809

[21] Appl. No.: 574,073

[22] Filed: Dec. 18, 1995

[51] Int. Cl.[6] ..... E04C 5/16

[52] U.S. Cl. ..... 52/677; 52/678; 52/679; 52/687; 52/689

[58] Field of Search ..... 52/677, 678, 679, 52/687, 689

[56] References Cited

U.S. PATENT DOCUMENTS

| | | | |
|---|---|---|---|
| 3,115,726 | 12/1963 | Sayles | 52/687 X |
| 3,451,179 | 6/1969 | Kendzia | 52/677 X |
| 3,693,310 | 9/1972 | Middleton | 52/689 X |
| 3,830,032 | 8/1974 | Robb | 52/687 |
| 4,000,591 | 1/1977 | Courtois | 52/689 |
| 4,060,954 | 12/1977 | Liuzza | 52/677 |
| 4,756,641 | 7/1988 | Hartzheim | 52/689 X |
| 4,835,933 | 6/1989 | Yung | 52/687 X |
| 5,058,348 | 10/1991 | Westhed | 52/687 X |
| 5,107,654 | 4/1992 | Leonardis | 52/677 X |
| 5,456,051 | 10/1995 | Queen et al. | 52/677 |

*Primary Examiner*—Wynn E. Wood
*Attorney, Agent, or Firm*—Llewellyn A. Proctor

[57] ABSTRACT

A chair for supporting, positioning and retaining a concrete reinforcing bar in place at predetermined height in the pouring and construction of concrete slabs or beams at a jobsite wherein the concrete reinforcing bar remains as an integral, strengthening element of the construction. The chair includes a cap with a recessed or slotted upper face for retaining and supporting the concrete reinforcing bar, and a base; the cap (which supports the concrete reinforcing bar) being supported above the base via a stem. Caps and bases of standard size can be supplied to a jobsite, and chairs of varying height readily constructed therefrom at the jobsite by cutting stems of desired length from a concrete reinforcing rod, based on the requirements of slab thickness, or beam depth.

18 Claims, 2 Drawing Sheets

CHAIRS OF ADJUSTABLE HEIGHT FOR USE IN CONCRETE CONSTRUCTIONS

SPECIFICATION

1. Field of the Invention

This invention relates to novel spacing devices, or chairs, as employed in the construction of concrete slabs, or beams. In particular, it relates to chairs of adjustable height for such usage.

2. Background

It is known to use various styles and forms of spacing elements for supporting and retaining concrete reinforcing materials, e.g., wire mesh, reinforcing rods, bars and the like, in elevated position while pouring and forming plastic, plastic-like and concrete forms, e.g., concrete slabs, or beams. Most are rigid members, constructed of plastic or metal; generally, iron or steel. These spacing elements, generally referred to as chairs, hold the wire mesh or rods above and away from the foundation or surface upon which the slab or beam is formed to enhance the strength of the finished slab, or beam. When the wet concrete is poured, the latter covers both the supports and the wire mesh or reinforcing rods; and all becomes a part of the finished slab, or beam, after the concrete has set.

It is particularly important to properly position the wire mesh or reinforcing rods within the slab or beam to enhance its strength. Most chairs sold in the marketplace are of rigid shape and of fixed height though the chairs are manufactured and sold in different specified heights. The mesh or reinforcing bar is held by a specified chair at a fixed preselected height above ground level. Since adjustment of the vertical height of a chair is not possible with devices of given height, it is thus necessary to use chairs of given preselected height for the slab poured at each jobsite; and since the thickness of poured concrete slabs are obviously not always the same this means that a supplier must furnish chairs of different heights for slab, or beam constructions of varying thicknesses. Obviously the thickness of a slab, or beam will vary from one jobsite to another; sometimes even at the same jobsite. For example, one manufacturer furnished "high chairs" made with fixed heights ranging, in one inch increments, from 2 inches to 18 inches; chairs of the same style and form having 17 different heights sized in one inch increments between 2" and 18". A special order is placed for high chairs of height greater than 18". This lack of standardization creates major problems for the supplier, not the least of which is that he must find storage space for all the different sizes of chair; albeit chairs of the same style and form. Moreover, chairs of the required height must be sent to the jobsite or the chairs cannot be used. Variations in the thicknesses of slabs, or beams at the same jobsite intensify the supply problem. Thus, there exists a need in the industry for greater standardization of these devices.

3. The Invention

The present invention accordingly, to meet this and other needs, relates to a novel chair of adjustable height which can be readily used in pouring plastic, plastic-like, and concrete forms, especially slab, or beam constructions, of different thicknesses.

The chair of this invention is constituted of three basic components, an upper cap, an intermediate member, or stem, and a base. The cap, upon which the mesh or reinforcing bar to be encapsulated into the cement is in direct physical contact, is constituted of a recessed, notched or slotted support surface in which is rested the mesh or reinforcing bar. The stem forms the connecting element between the cap and the base, a member which is most conveniently supplied at the jobsite suitably by cutting a concrete reinforcing rod into a length appropriate for the thickness of the slab or beam to be constructed. The base is constituted of a multileg member, suitably as a unitary structure the lower side of which is flat, or provided with projecting feet, and the upper side of which contains an opening or receptacle in which the lower terminal end of the stem can be inserted, secured, and supported. The cap is mounted upon the opposite terminal end of the stem. The height of the chair is determined by the sum-total of the height of the cap, the base, and by the stem which is cut at the jobsite to the length desired to adjust the chair to the desired height.

A supplier need only stock the caps and bases, as items of standard size. At the jobsite a chair of the height needed for the slab, or beam construction is prepared for use by a workman who cuts stems as needed of the desired length from an iron concrete reinforcing bar with shears or saw.

These and other characteristics of the chair of this invention will be better understood by reference to the following detailed description. In describing a preferred embodiment, reference is made to the drawing.

Figure 1:
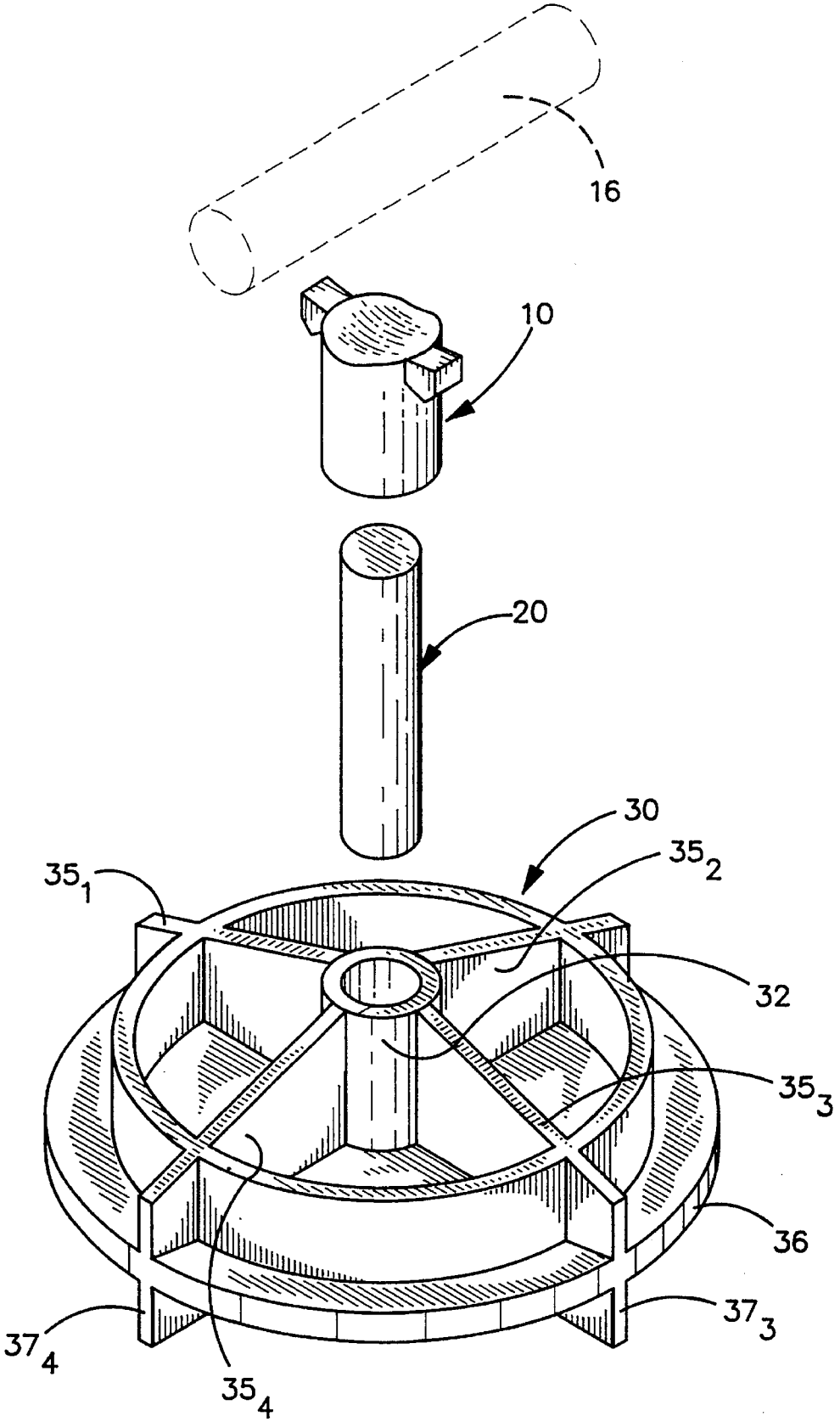
FIG. 1 depicts an exploded view, in isometric form of the three components of the chair; inclusive of a stem which is located between the cap and base.
Figure 2:
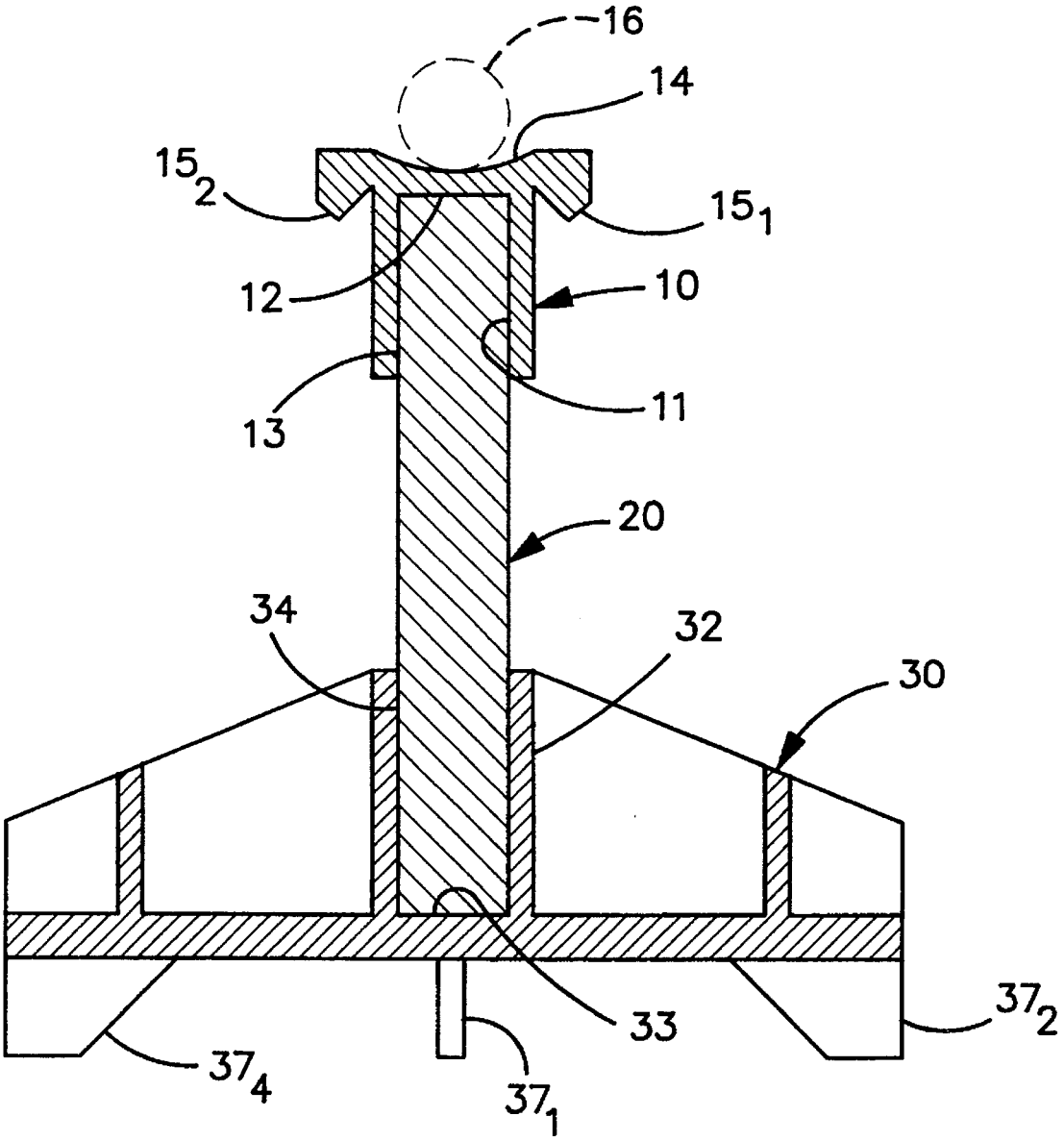
FIG. 2 depicts a section view of the chair as used in the support of a concrete reinforcing bar.

Referring generally to FIGS. 1 and 2 there is shown a cap 10, a stem 20 and base 30; these components, when assembled, constituting a complete chair. Cap 10 and base 30 are preferably molded shapes supplied in standard size to a jobsite, and stem 20 is produced at the jobsite.

The cap 10 embodies a tubular member having a lower opening formed by an enclosing side wall 11, and upper enclosing wall 12 providing a receptacle 13 within which the upper end of the stem 20 can be fitted, and held in place. The upper surface of the cap 10 is provided with a slot 14 within which a reinforcing bar 16 can be held in place, and supported (FIG. 2). A pair of ears $\mathbf{15}_1$, $\mathbf{15}_2$ are optionally, and preferably provided, for use in using wire to tie down the reinforcing bar 16, supported therein; if desired.

The base 30 constitutes the foundation, or bottom support for the cap 10, and stem 20. It is preferably constituted of a multilegged unitary structure at the center of which is located an upwardly opening tubular member formed by an enclosing side wall 32, and enclosing bottom wall 33 forming a receptacle 34 into which the lower terminal end of the stem 20 can be held, and supported. On one side the legs $\mathbf{35}_1$, $\mathbf{35}_2$, $\mathbf{35}_3$, $\mathbf{35}_4$ are secured to the receptacle portion 34 of the tubular member, and on the other by the encircling ring member 36 which creates the unitary structure. The bottom of the base 30 may be flat; or, optionally, both flat and arrayed with feet $\mathbf{37}_1$, $\mathbf{37}_2$, $\mathbf{37}_3$, $\mathbf{37}_4$ for supporting the chair upon a concrete form or other type of rigid foundation.

The external diameter of the stem 20 approximates the internal diameter of the receptacle portion of tubular member 34, and tubular opening 13 within the cap 10. The lower terminal end of the stem 20, conveniently a concrete reinforcing rod cut on the job to the desired length, rests in the receptacle portion, or upper opening of tubular member 34, and the upper end thereof is fitted within the opening within the cap 10. The height of the chair is determined by the height of the cap 10 and the base 30 which is fixed, and the readily adjustable height of the stem 20 which is controlled by the worker who cuts it to the desired length at the jobsite.

It is thus no longer necessary to supply the whole chair to a jobsite. A supplier need only supply standardized caps and bases. The height of the chair needed or a jobsite is there decided, and lengths of concrete reinforcing rod are cut to the length necessary to provide, with the caps and bases, chairs of the desired height.

Various changes, such as in absolute or relative dimensions of the parts, materials and the like, can be made without departing the spirit and scope of the invention, as will be apparent to those skilled in the art.

Having described the invention, what is claimed is:

1. Apparatus characterized as a chair said apparatus supporting, positioning and retaining a concrete reinforcing bar in place at predetermined height in the pouring and construction of concrete slabs beams at a jobsite wherein the concrete reinforcing bar remains as an integral element of the slab beam construction, which comprises a cap constituted of a tubular member having an upper face and a downwardly faced lower opening, the upper face of which is provided with a slot retaining and supporting the concrete reinforcing bar, the downwardly faced lower opening being formed by an enclosing side wall and upper wall forming a downwardly faced receptacle, a base containing an upwardly faced receptacle opening, and a stem having an upper terminal end and a lower terminal end, the upper terminal end of which can be fitted into the downwardly faced receptacle provided in the cap, the lower terminal end which can be fitted into the receptacle in the base, said stem being readily cut into desired lengths to provide a chair of adjustable height as predetermined by slab and beam thickness, whereby, said cap and said base can be shipped to a jobsite and a chair of needed height can be assembled therefrom by simply cutting the stem to a required length, and using said stem to complete formation of the chair based on requirements of slab and beam thickness.

2. The apparatus of claim 1 wherein the cap is provided with projecting ears to facilitate tying the concrete reinforcing rod to the chair.

3. The apparatus of claim 1 wherein the base is provided with an upper face and bottom face, is multilegged, and constructed as a unitary member.

4. The apparatus of claim 3 wherein the base is of circular shape, and the bottom face thereof is flat.

5. The apparatus of claim 3 wherein the base is of circular shape, and the bottom face thereof is provided with a plurality of feet for supporting the chair on a foundation.

6. The apparatus of claim 1 wherein the stem is a segment of a concrete reinforcing rod.

7. The apparatus of claim 1 wherein the cap is provided with projecting ears which serve as tie points to facilitate tying the concrete reinforcing rod to the chair, and the base is multilegged, constructed as a unitary member, and the stem is a segment of a concrete reinforcing rod.

8. The apparatus of claim 7 wherein the base is of circular shape, and the bottom face thereof is flat.

9. The apparatus of claim 7 wherein the base is of circular shape, and the bottom face thereof is provided with a plurality of feet for supporting the chair on a foundation.

10. Apparatus for the construction of a chair, said apparatus supporting, positioning and retaining a concrete reinforcing bar in place at predetermined height in the pouring and construction of a concrete slab and beam at a jobsite wherein a stem, having an upper terminal and a lower terminal end, is added to complete the chair which, with the supported concrete reinforcing bar, remains an integral element of the slab or beam construction, which comprises a cap constituted of a tubular member having an upper face and a downwardly faced lower opening, the upper face of which is provided with a slot retaining and supporting the concrete reinforcing bar, the downwardly faced lower opening being formed by an enclosing side wall and upper wall forming a downwardly faced receptacle, and a base containing an upwardly faced receptacle opening whereby, the cap and base can be assembled with the stem cut in desired lengths to provide a chair of adjustable height as predetermined by slab and beam thickness, the upper terminal end of the stem being fitted into the downwardly faced receptacle provided in the cap, and lower terminal end fitted into the receptacle in the base, to complete formation of the chair at the jobsite.

11. The apparatus of claim 10 wherein the cap is provided with projecting ears to facilitate tying the concrete reinforcing rod to the chair.

12. The apparatus of claim 10 wherein the base is multilegged, and constructed as a unitary member.

13. The apparatus of claim 12 wherein the base is of circular shape, and the bottom face thereof is flat.

14. The apparatus of claim 12 wherein the base is of circular shape, and the bottom face thereof is provided with a plurality of feet for supporting the chair on a foundation.

15. The apparatus of claim 10 wherein the stem is a segment of a concrete reinforcing rod.

16. The apparatus of claim 10 wherein the cap is provided with projecting ears which serve as tie points to facilitate tying the concrete reinforcing rod to the chair, and the base is multilegged, constructed as a unitary member, and the stem is a segment of a concrete reinforcing rod.

17. The apparatus of claim 16 wherein the base is of circular shape, and the bottom face thereof is flat.

18. The apparatus of claim 16 wherein the base is of circular shape, and the bottom face thereof is provided with a plurality of feet for supporting the chair on a foundation.

* * * * *